United States Patent [19]

Konno et al.

[11] 3,994,555

[45] Nov. 30, 1976

[54] CONNECTOR CASING

[75] Inventors: Kunio Konno; Tomonari Otsuki, both of Tokyo, Japan

[73] Assignee: Bunker Ramo Corporation, Oak Brook, Ill.

[22] Filed: Mar. 4, 1975

[21] Appl. No.: 555,260

[30] Foreign Application Priority Data

Mar. 4, 1974 Japan ..... 49-24598[U]

[52] U.S. Cl. ..... 339/103 R; 339/59 R; 339/91 R

[51] Int. Cl.[2] ..... H01R 13/58

[58] Field of Search ..... 339/103 R, 103 C, 103 M, 339/107, 91 R, 61 R, 61 M, 59 R, 59 M

[56] References Cited

UNITED STATES PATENTS

| | | | |
|---|---|---|---|
| 3,332,053 | 7/1967 | Busler | 339/59 R X |
| 3,519,978 | 7/1970 | Taormina et al. | 339/59 M |
| 3,781,766 | 12/1973 | Teagno et al. | 339/107 |

*Primary Examiner*—Roy Lake
*Assistant Examiner*—DeWalden W. Jones
*Attorney, Agent, or Firm*—F. M. Arbuckle

[57] ABSTRACT

A connector casing offering advantages in reducing the number of parts, at simplification of assembly and at reorganization and integration of parts management. According to this invention, there is provided a connector casing made of flexible synthetic resin and molded in one piece in rectangular box-like form. The casing has a top and a bottom hinged together at one rear edge thereof by a pair of hinge planes also integral with the casing. A front wall of the top and bottom have mating arched indentations to provide a cable opening when the casing is closed. Snap lock means are provided on the front walls and along each side of the top and bottom. Each side wall has a connector support near the rear. A rectangular opening is provided at the rear between the hinge planes to accommodate connection to a connector held in the casing. The casing will also accept flat cables and will accommodate metal cord holders about the cord.

5 Claims, 5 Drawing Figures

CONNECTOR CASING

FOREIGN PRIORITY CLAIMED

Applicants claim priority under 35 USC 119 to their corresponding application Ser. No. [U] 49-24598 filed in Japan on Mar. 4, 1974.

BACKGROUND OF THE INVENTION

As for prior art multi-core connectors which are used in various electronic devices, such as electronic measuring devices, a female connector and a male connector are encased in separate cases and then connected together. Each casing is designed to conceal the section where the contact terminals and wires are connected, and to provide a strain relief to secure the wires so that the connections between the terminals and the wires will not come loose when outside force is applied.

For example, in a known design, the casing is constructed of two separate parts. A connector is placed in a connector securing frame of the bottom part of the casing, and a metal strain relief clip for the cord is placed in a clip securing frame of the bottom part. Then, the top part of the casing is placed on top of the bottom part of the casing and secured by means of screws. The top part of the casing has a mating connector securing frame and a mating clip securing frame for the metal strain relief clip, so that when the top and the bottom parts are put together they will form two separate encasements, one for the connector and one from the clip. However, a casing of such construction as that described above requires two metal molds in order to make it, and production is troublesome, thus resulting in high cost. Assembly with the connector inside also requires more work than with the present invention. In addition, management of parts is troublesome because of the many pieces. Moreover, male and female connectors may require separate designs for the casing.

BRIEF SUMMARY OF THE INVENTION

An object of this invention is to provide a connector casing not subject to the above-noted shortcomings.

Another object of the invention is to provide a connector casing made of flexible synthetic resin and molded in one piece in rectangular box-like form having a top portion and a bottom portion hinged together at the rear by a pair of hinge planes.

According to the invention, a connector casing is provided which is made of flexible synthetic resin and the entire casing with all the detail described below is molded in one piece.

The connector casing is made of flexible synthetic resin and molded in one piece in rectangular box-like form. The casing has a top and a bottom hinged together at one rear edge thereof by a pair of hinge planes also integral with the casing. A front wall of the top and bottom have mating arched indentations to provide a cable opening when the casing is closed. Snap lock means are provided on the front walls and along each side of the top and bottom. Each side wall has a connector support near the rear. A rectangular opening is provided at the rear between the hinge planes to accommodate connection to a connector held in the casing. The casing will also accept flat cables and will accommodate metal cord holders about the cord.

More particularly, the bottom portion of the casing is like the bottom half of a shallow rectangular box and its front wall has an arched indentation at the center for cord insertion. Immediately inside the front wall there is an encasement framework for the cord's strain relief clip, usually a metal clip secured about the end of the cable. The front wall acts as one side of the clip framework. The wall of the clip framework opposite the front wall also has an arc-shaped indentation. The top portion of the casing has similar structure as that described for the bottom portion and mates therewith when the casing is closed.

The front wall of the bottom portion does not extend the full length of the casing, and at each end of the front wall there is a snap-lock receiving piece with an insertion hole for the snap-lock tab. Each bottom sidewall has a connector support at the rear, and an arrow-shaped snap-lock tab lies alongside each sidewall. The arrow-shaped snap-lock tab has a cleft in the middle. At the rear in the bottom wall of the bottom portion, there is a rectangular opening which allows for making connection to the encased connector.

The front wall of the top portion extends the full front length of the casing, except for two gaps at places corresponding to the positions of the snap-lock receiving pieces. At each end of the top front wall there is an L-shaped snap-lock tab which bends toward the front wall at its free end. The base of the L-shaped tab is made thin for easy bending. Each top sidewall has a connector support at the rear. Also there is a snap-lock receiving block with an insertion opening for the arrow-shaped snap-lock tab of the bottom portion alongside each top sidewall.

There is also a rectangular opening for making connection to the encased connector in the top wall at the rear of the top portion.

The two parts, top and bottom, of the casing are connected by means of the two hinge planes which have a third rectangular opening between them for making connection to the encased connector. Flexible joints between the hinge planes and the bottom portion of the casing, and between the hinge planes and the top portion of the casing are made thin for easy bending.

When the bottom portion and the top portion are closed together, the front wall has a round opening for insertion of a round cord therein. The cord opening also has a horizontal gap continuous with the opening and positioned between the top half and the bottom portions for insertion of a flat cord.

A connector is encased and secured by placing it on the connector support and by placing the cord strain relief clip in the encasing frame of the bottom portion of the casing and by pulling down (shutting) the top portion. When closed, the arrow-shaped snap-lock tabs will snap into the receiving blocks through the insertion openings. Finally, the L-shaped snap-lock tabs will be inserted into the snap-lock receiving pieces to lock the casing shut.

BRIEF DESCRIPTION OF THE DRAWING

The invention will now be described in detail with reference to the accompanying drawings representing preferred embodiments of the connector casing according to the present invention. In the drawings.

DETAILED DESCRIPTION OF THE PREFERRED EMBODIMENTS

Figure 1:
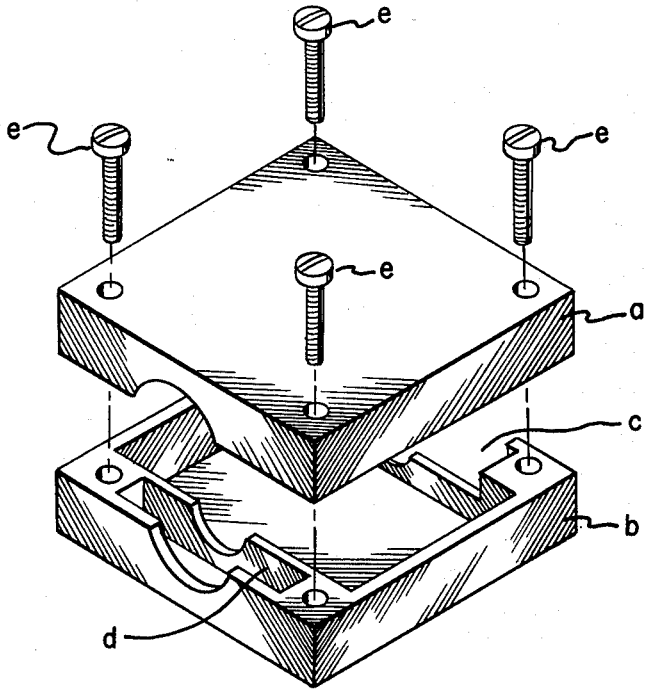
FIG. 1. ( Prior Art )
FIG. 1 is a perspective view of a prior art connector casing.

In FIG. 1, a prior art casing is shown, and the disadvantages of such a device are obvious, i.e., multiple pieces, difficult to assemble and service, expensive to manufacture, and difficult to store and manage parts for the device.

The casing based on this invention is intended to result in reorganization and integration in production management by reducing the number of parts, and has several unique characteristics.

Figure 2:
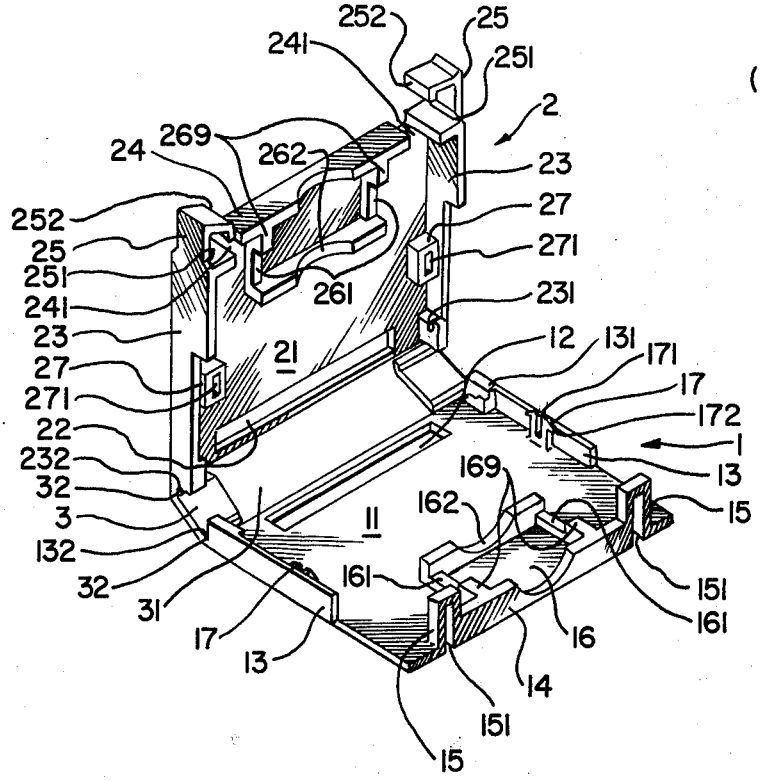
FIG. 2 is a perspective view of a connector casing made in accordance with this invention.

Manufacturing and management of parts are made easier by molding the entire casing in a single unitary piece as shown in FIG. 2. The bottom portion 1 of the casing is connected to the top portion 2 of the casing by means of hinge planes 3. The casing is made of a material which is resilient against repeated bending and does not crack easily or break at the places it is bent—such as (for example) polypropylene resin.

Connection to connectors encased in the casing can be made in three different ways because of the connection openings 31, 12, 22 made in the three surface planes top, bottom, and back. That is, connectors which allow different angles of connection to be made can be used with a single kind of casing. In addition, the casing can be used for either a male or a female connector. Thus the necessity for different kinds of casing is diminished.

At each end of the front wall 24 there is L-shaped snap-lock tab 25, and the casing can be locked securely by inserting the L-shaped snap-lock tab into the snap-lock receiving piece 15. The casing cannot be opened even when strong outside force is applied on the cord unless the L-shaped snap-lock tabs are unfastened. Thus a connector and its cord can be fixed securely in the casing without use of screws. Therefore, connection and encasement are easily achieved with fewer parts and fewer steps than with the prior art.

Each front wall 14, 24 has a horizontal gap 141 equidistant from top and bottom with a round enlargement 142 in the middle when the casing is closed so that the casing can be used for either a flat cord or a round multi-core cable.

In FIG. 2, the casing is shown to have a floor 11 in the bottom half 1 of the casing, and a ceiling 21 in the top half 2 of the casing. The connection openings 31, 12, 22 are provided for making connection to the encased connector.

Figure 3:
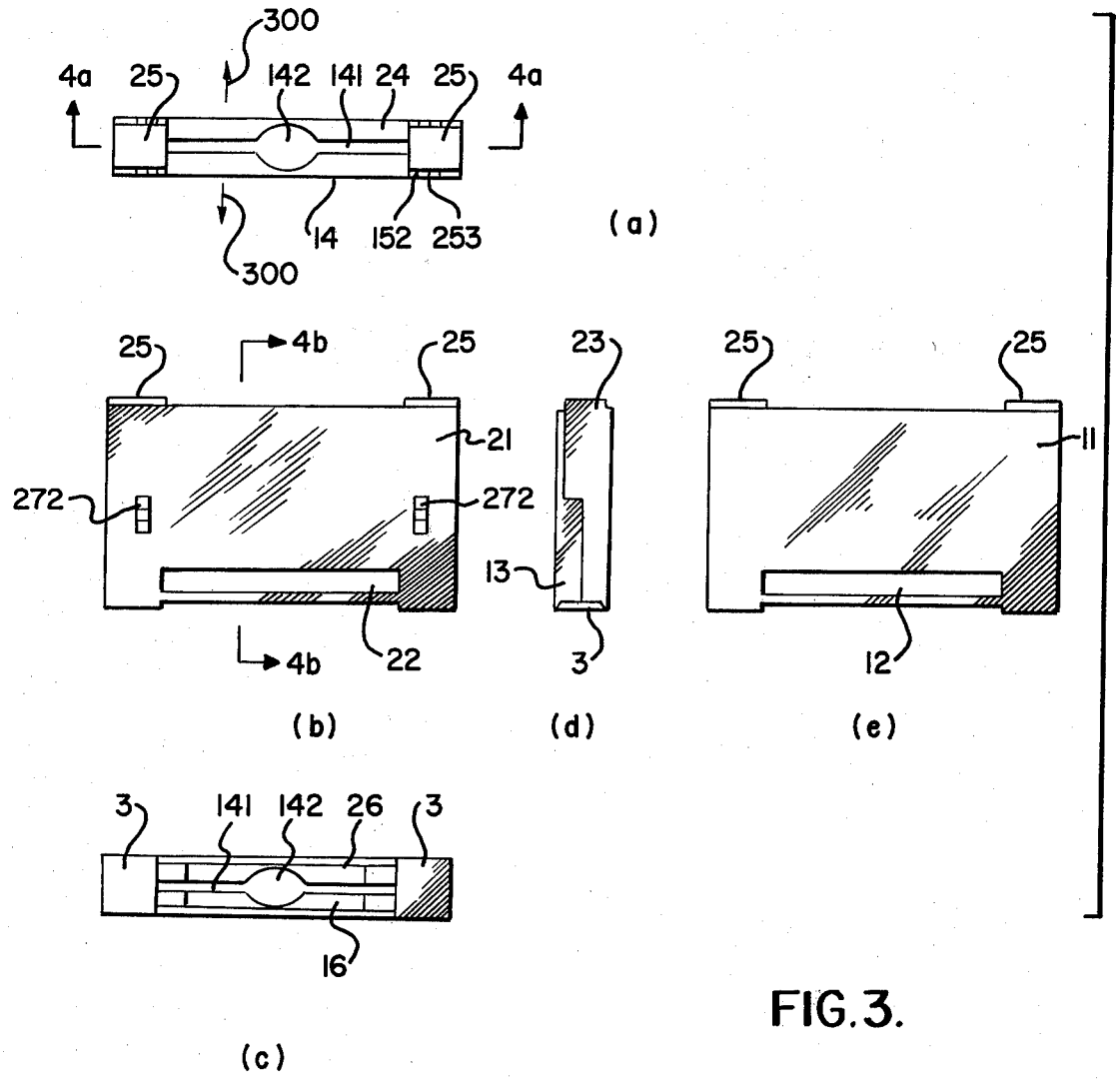
FIG. 3*a*, *b*, *c*, *d* and *e* are front, top, rear, side and bottom views of the closed casing of this invention.
Figure 5:
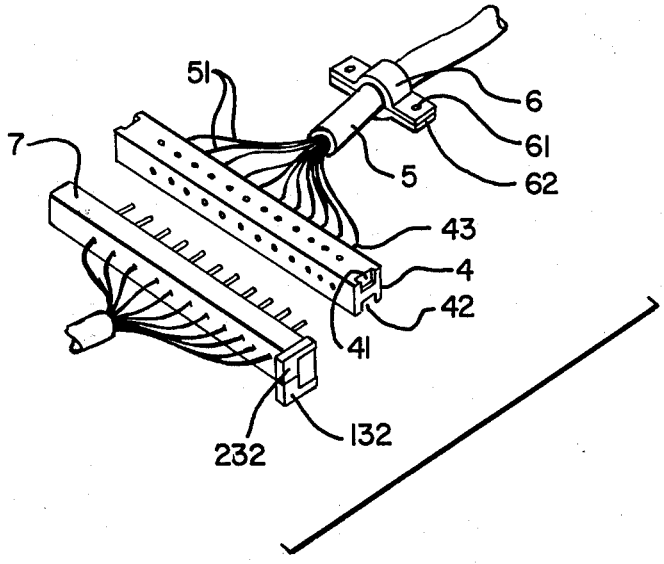
FIG. 5 is a perspective view of an exemplary connector with cable and strain relief for use in the connector casing of this invention.

Each section where the bottom 1 is connected to the hinge plane 3, and where the top 2 is connected to the hinge plane 3, is made very thin, for example at 32, for easy bending and also for neat appearance when bent. Sidewalls 13, 23 are provided extending front to rear. The sidewall 13 extends about half of the length of the casing, and the sidewall 23 is made to fill the space left by the sidewall 13 when the casing is closed. A view of the sidewalls when the casing is closed is shown in FIG. 3*d*. At the rear corner on each sidewall 13, 23 there is the connector support 131, 231. These connector supports are pushed into the concave sections 41, 42 (as shown in FIG. 5) of each end of the connector, and secures the connector.

Small gaps 132, 232 are provided at the rear end of the sidewalls 13, 23, and these gaps will enable a tight fit when the casing is closed.

Front walls 14, 24 are designed and shaped such that when the casing is closed there will be a horizontal gap 141 with a round enlargement 142 in the middle (as shown in FIG. 3*a*.

Snap-lock receiving piece 15 is positioned at each end of the front wall 14. The snap-lock receiving piece 15 has a slender opening 151 which is at a right angle to the lengthwise direction of the front wall. A gap 241 is provided on the top front wall 24 and the snap-lock receiving piece is fitted into this gap. An L-shaped snap-lock tab 25 is placed at each end of the top front wall 24. The L-shaped snap-lock tab 25 bends at the thin section 251 in the lengthwise direction of the front wall 24. After the casing is closed, the L-shaped snap-lock tab 25 is bent at the thin section 251, and the tip 252 is inserted into the opening 151 of the snap-lock receiving piece 15 which is fitted into the gap 241 of the top front wall 24.

Figure 4:
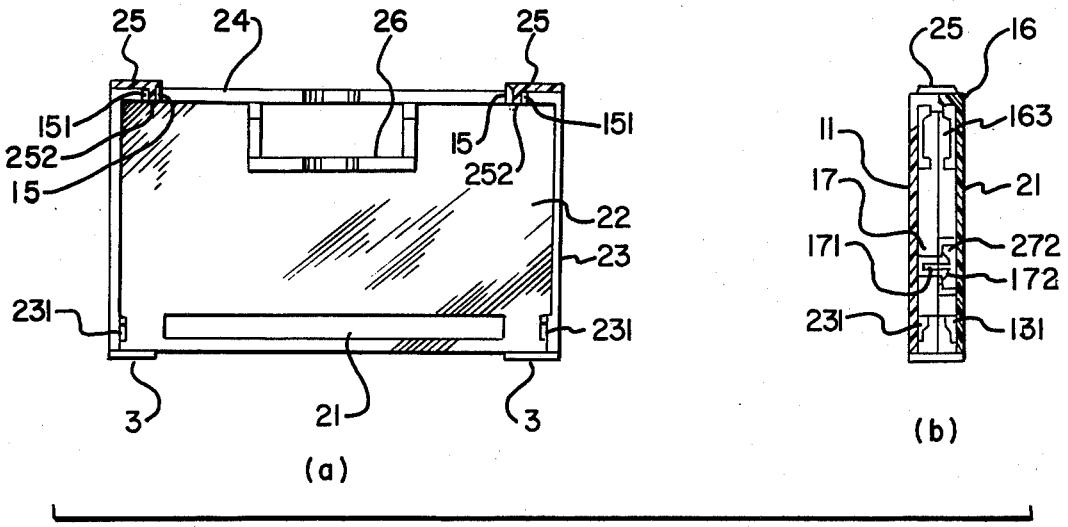
FIG. 4*a* is a sectional view taken along lines 4*a*—4*a* in FIG. 3*a;*
FIG. 4*b* is a sectional view taken along lines 4*b*—4*b* in FIG. 3*b*.

When the L-shaped snap-lock tab 25 is snapped in and is in the locked position, the tip 252 springs back due to flexibility of the material and gets caught inside the opening 151 of the snap-lock receiving piece 15 as shown in FIG. 4*a*. Therefore, even when a force is applied to open the casing in the direction of the arrows 300 as shown in FIG. 3*a*, the casing will not open, because the lower end 253 of the snap-lock 25 is stopped by lower end 152 of the receiving opening 151. Thus, the connector and its cord will be fixed securely and will not become loose unless the snap-lock tabs 25 are pulled out.

Encasement frames 16, 26 are provided for the metal cord holder or strain relief clip 61 (FIG. 5) and each is of the same height as that of the front walls 14 and 24 respectively. The walls 162, 262 of the encasement frames opposite the front walls 14, 24 have an arched indentation (in each) just like the ones on the front walls 14, 24. Thus, when the casing is closed, there is a horizontal gap 141 with a round enlargement 142 in the middle on the encasement wall 162, 262 opposite the front walls 14, 24. On each sidewall 169, 269 of the encasement frame, there is an indentation 161, 261 where the "ears" 62 of the strain relief 6 (shown in FIG. 5) will be placed. Thus when the casing is closed, the encasement frames of the top section of the casing and of the bottom section of the casing will together form an encasement 163 as shown in FIG. 4*b* in which the metal cord holder will be held and secured. When the cord is pulled by an outside force, the force will not affect the area where the contact terminals and the wires are connected.

The arrow-shaped snap-lock tab 17 has a cleft 171, and is positioned on the bottom section 1 of the casing. The receiving block 27 is provided for the arrow-shaped snap-lock tab 17, and is located in the top section 2 of the casing. There is an opening 271 on the receiving block for insertion of the arrow-shaped snap-lock tab 17. When the arrow-shaped snap-lock tab 17 is inserted through the opening, it is cammed and made narrow, which is permitted by the cleft 171 in the middle. After the arrow-shaped snap-lock tab 17 goes through the opening, it returns to its original shape and becomes locked in, as shown in FIG. 4*b*.

Encasement of a connector is accomplished by means of the following steps. The cable wires 51 of the cable 5 are connected to the contact terminals 43 of, for example, a female connector 4 (shown in FIG. 5). Then the metal strain relief clip 6 is secured on the cable 5 with screws 61. The concave sections 42 of the connector 4 are pushed onto the supports 131 of the bottom section 1 of the casing. The strain relief clip is then placed in its encasement frame 16 of the bottom section 1 of the casing. Then the top section 2 of the casing is pushed down on top of the bottom section. When the casing is closed, the connector supports 231 of the top section of the casing fit into the other concave sections of the connector, and then the arrow-shaped snap-lock tabs 17 are locked in place. In this fashion, the connector 4 and the strain relief clip 6 become encased. Then the encasement is completed by inserting the L-shaped snap-lock tabs 25 into the openings 151 of the snap-lock receiving pieces 15. As can be easily seen, the assemblage can be done in a short time and done easily without using screws or tools. Also, the casing will not open even when outside force is applied to the cable. Therefore, the concealment of the connection between the terminals and wires and securing of the cable are quite reliable. Since the entire casing, including the L-shaped snap-lock, etc., is made in one piece, only one mold is needed for manufacturing. This results in easy production and low cost. Also management of a stock of parts is easier. Since there are three openings for connecting the connectors, a female connector with three connection "mouth surfaces", or female connectors with a single connection "mouth surface" but facing in various directions, can be made. The casing can be used also for male connectors. Therefore, the invention provides a casing with various advantages which are not present in known casings.

From the foregoing, it can be readily realized that this invention can assume various embodiments. For example, other suitable methods and means for mounting the strain relief clip are possible, and provision of an installation hole on the bottom is possible. Thus, it is to be understood that the invention is not limited to the specific embodiments described herein, but is to be limited only by the appended claims.

We claim:

1. A connector casing for housing a connector and attached cable, said casing including:

a bottom portion;

a top portion;

means in at least one of said portions for securing a connector therewithin;

an entry port for entry of a cable to the inside of said casing;

at least one access opening for making connection to a connector within said casing;

the improvement in which said top and bottom portions are formed of a unitary one-piece construction and further comprising:

hinge means connected between said top and bottom portions; and latch means for locking said top and bottom portions in a closed position, wherein each of said top and bottom portions are generally rectangular in form and have a flat planar surface with a front wall, and parallel and opposite sidewalls, all the walls of each portion being substantially perpendicular to said planar surface of that portion; and wherein said strain relief clip has ears extending therefrom and said interior sidewalls have indentations to accept the ears of said clip.

2. A connector casing for housing a connector and attached cable, said casing including:

a bottom portion;

a top portion;

means in at least one of said portions for securing a connector therewithin;

an entry port for entry of a cable to the inside of said casing;

at least one access opening for making connection to a connector within said casing;

the improvement in which said top and bottom portions are formed of a unitary one-piece construction and further comprising:

hinge means connected between said top and bottom portions; and latch means for locking said top and bottom portions in a closed position, wherein each of said top and bottom portions are generally rectangular in form and have a flat planar surface with a front wall, and parallel and opposite sidewalls, all the walls of each portion being substantially perpendicular to said planar surface of that portion; and wherein:

the front wall of said bottom portion has a length shorter than the distance between said sidewalls, and comprises at each of its ends a snap-lock receiving piece having an insertion opening for a snap-lock tab; and the front wall of said top portion extends the full length of the casing except for two gaps near its ends, which gaps receive said snap-lock receiving pieces of said bottom portions.

3. The connector casing as claimed in claim 2 including an L-shaped snap-lock tab projecting forwardly from the front wall of said top portion and adapted to snap-fit into the openings in said snap-lock receiving pieces when said casing is closed, said snap-lock receiving pieces and said snap-lock tabs defining a part of said latch means.

4. A connector casing for housing a connector and attached cable, said casing including:

a bottom portion;

a top portion;

means in at least one of said portions for securing a connector therewithin:

an entry port for entry of a cable to the inside of said casing;

at least one access opening for making connection to a connector within said casing;

the improvement in which said top and bottom portions are formed of a unitary one-piece construction and further comprising:

hinge means connected between said top and bottom portions; and latch means for locking said top and bottom portions in a closed position, wherein each of said top and bottom portions are generally rectangular in form and have a flat planar surface with a front wall, and parallel and opposite sidewalls, all the walls of each portion being substantially perpendicular to said planar surface of that portion; and wherein said latch means comprises:

an arrow shaped snap-lock tab approximately central of each of said sidewalls of said bottom portion; and a snap-lock receiving block having an insertion opening therein approximately central of each of said sidewalls of said top portion and adapted to receive said arrow-shaped snap-lock tabs of said bottom portion.

5. The connector casing as claimed in claim 3 wherein said L-shaped tabs have thinned portions to render the connection between said L-shaped tabs and said top portion more flexible.

* * * * *